US007514022B2

(12) United States Patent
Miyazawa et al.

(10) Patent No.: US 7,514,022 B2
(45) **Date of Patent: *Apr. 7, 2009**

(54) COMPOSITE PLATED PRODUCT AND METHOD FOR PRODUCING SAME

(75) Inventors: Hiroshi Miyazawa, Honjo (JP); Akito Inoue, Honjo (JP)

(73) Assignee: Dowa Mining Co., Ltd. (JP)

( * ) Notice: Subject to any disclaimer, the term of this patent is extended or adjusted under 35 U.S.C. 154(b) by 166 days.

This patent is subject to a terminal disclaimer.

(21) Appl. No.: 11/158,947

(22) Filed: Jun. 21, 2005

(65) Prior Publication Data

US 2005/0282006 A1 Dec. 22, 2005

(30) Foreign Application Priority Data

Jun. 21, 2004 (JP) ..... 2004-182296
Jun. 9, 2005 (JP) ..... 2005-169082

(51) Int. Cl.
*H01B 1/00* (2006.01)

(52) U.S. Cl. ..... 252/500; 252/510; 106/31.6; 106/31.9; 106/475; 106/478; 205/109; 205/125; 205/148; 205/149; 205/159; 205/539; 428/626; 428/680

(58) Field of Classification Search ..... 426/626; 252/500, 182.1, 62.1, 510; 205/159, 109, 205/125, 148, 149, 539; 234/449.1; 106/475, 106/31.6, 31.9, 478; 200/265; 423/449.4; 523/161; 428/680, 626
See application file for complete search history.

(56) References Cited

U.S. PATENT DOCUMENTS 3,318,720 A * 5/1967 Johnson et al. ..... 106/478
3,347,632 A * 10/1967 Parker ..... 423/449.4
3,550,247 A 12/1970 Evans et al.
3,620,792 A * 11/1971 Hagopian ..... 106/478
3,787,294 A * 1/1974 Kurosaki et al. ..... 205/109
3,959,008 A * 5/1976 Warner et al. ..... 106/478

(Continued)

FOREIGN PATENT DOCUMENTS

GB 1236954 A * 4/1968

(Continued)

OTHER PUBLICATIONS

Dispersion Aids For Carbon Blacks in Aqueous Systems, Special Blacks Division, Cabot Corporation, Billerica, MA.*

(Continued)

*Primary Examiner*—Douglas Mc Ginty
*Assistant Examiner*—Khanh Tuan Nguyen
(74) *Attorney, Agent, or Firm*—Bachman & LaPointe, P.C.

(57) ABSTRACT

There is provided a composite plated product which has a large content of carbon and a large quantity of carbon particles on the surface thereof and which has an excellent wear resistance, by sufficiently dispersing carbon particles in a silver plating solution without using any additives such as dispersing agents and without coating the surface of carbon particles. A wet oxidation treatment for carbon particles is carried out by adding an oxidizing agent to water in which the carbon particles are suspended, and the carbon particles treated by the wet oxidation treatment are added to a cyanide containing silver plating solution for electroplating a substrate to form a coating of a composite material, which contains the carbon particles in a silver layer, on the substrate.

12 Claims, 4 Drawing Sheets

U.S. PATENT DOCUMENTS

| | | | | |
|---|---|---|---|---|
| 4,652,349 | A * | 3/1987 | Behringer et al. | 205/109 |
| 4,680,093 | A * | 7/1987 | Morin | 428/626 |
| 4,724,005 | A * | 2/1988 | Minten et al. | 106/475 |
| 4,908,106 | A * | 3/1990 | Takeshima et al. | 205/148 |
| 4,997,531 | A * | 3/1991 | Yoshio et al. | 205/539 |
| 5,139,642 | A * | 8/1992 | Randolph et al. | 205/125 |
| 5,199,553 | A * | 4/1993 | Shinohara et al. | 200/265 |
| 5,290,422 | A * | 3/1994 | Michelsen-Mohammadein | 205/109 |
| 5,725,807 | A * | 3/1998 | Thorn et al. | 252/510 |
| 5,759,378 | A * | 6/1998 | Ferrier et al. | 205/159 |
| 5,905,102 | A * | 5/1999 | Nagasawa et al. | 523/161 |
| 5,911,865 | A * | 6/1999 | Yih | 205/149 |
| 6,123,759 | A * | 9/2000 | Mise et al. | 106/31.9 |
| 6,190,789 | B1 * | 2/2001 | Beppu et al. | 428/680 |
| 6,231,619 | B1 * | 5/2001 | Florio et al. | 205/126 |
| 6,565,731 | B1 * | 5/2003 | Couble et al. | 205/125 |
| 6,852,156 | B2 * | 2/2005 | Yeh et al. | 106/31.6 |
| 2005/0042164 | A1 * | 2/2005 | Kennedy et al. | 423/449.1 |
| 2005/0199504 | A1 * | 9/2005 | Lee | 205/159 |

FOREIGN PATENT DOCUMENTS

| | | | |
|---|---|---|---|
| GB | 1534429 | | 12/1978 |
| GB | 2217347 | A * | 10/1989 |
| JP | 3-253598 | | 11/1991 |
| JP | 5-505853 | | 8/1993 |
| JP | 9-7445 | | 1/1997 |

OTHER PUBLICATIONS

The Fundamentals of Carbon Black, Cabot Corporation, Billerica, MA*

Donnet et al., Etude de l' action chimique des oxydants sur le noir de carbhone, Ecole Superieure de Chemie de Mulhouse, No. 294 (1962) pp. 1727-1735. (English Translation Attached).*

Foster et al., "Dispersion aids for carbon blacks in aqueous systems," European Polymers Paint Colour Journal, Jun. 1994.*

Toni Paterson, "The Fundamentals of Carbon Black," SPE/ANTEC 1999 Proceedings: Proceedings of the 57th Conference Held May 1999 By Society of Plastics Engineers, Antec, Spe, May 1999, pp. 2890-2891.*

* cited by examiner

COMPOSITE PLATED PRODUCT AND METHOD FOR PRODUCING SAME

BACKGROUND OF THE INVENTION

1. Field of the Invention

The present invention generally relates to a composite plated product and a method for producing the same. More specifically, the invention relates to a composite plated product which is used as a material of sliding contact parts such as switches and connectors.

2. Description of the Prior Art

Conventionally, as materials of sliding contact parts such as switches and connectors, there are used silver-plated products wherein a conductive material such as copper or a copper alloy is plated with silver in order to prevent oxidation of the conductive material due to heat in sliding processes.

However, there is a problem in that silver coatings are easily stripped by sliding since they are soft and easily wear and since they generally have a high coefficient of friction. In order to solve this problem, there is proposed a method for electroplating a conductive material with a composite material wherein graphite particles of carbon particles, such as graphite and carbon black particles, having good heat resistance, wear resistance and lubricity, are dispersed in a silver matrix, in order to improve the wear resistance of the conductive material (see, e.g., Japanese Patent Laid-Open No. 9-7445). There is also proposed a method for producing a silver coating, which contains graphite particles, by means of a plating bath to which a wetting agent suitable for the dispersion of graphite particles is added (see, e.g., Japanese Patent Unexamined Publication No. 5-505853 (National Publication of Translated Version of PCT/DE91/00241)). Moreover, there is proposed a method for coating carbon particles with a metal oxide or the like by the sol-gel method to enhance the dispersibility of the carbon particles in a composite plating bath of silver and the carbon particles to increase the quantity of carbon particles in a composite coating (see, e.g., Japanese Patent Laid-Open No. 3-253598).

However, in the methods disclosed in Japanese Patent Laid-Open No. 9-7445 and Japanese Patent Unexamined Publication No. 5-505853, since it is required to add a dispersing agent or wetting agent for dispersing carbon particles in a silver plating bath, there are some cases where a surface active agent used as the dispersing agent or the like is absorbed onto the surface of carbon particles as well as the surface of a coating, so that the dispersing agent or the like has a bad influence on the formation of the coating. In the method disclosed in Japanese Patent Laid-Open No. 3-253598, no dispersing agent is used. However, usable plating solutions are limited in accordance with the material of a coating such as a metal oxide. For example, cyanide containing plating solutions and strong acid plating solutions can not used.

Composite plated products produced by the methods disclosed in Japanese Patent Laid-Open No. 9-7445, Japanese Patent Unexamined Publication No. 5-505853 and Japanese Patent Laid-Open No. 3-253598 have a relatively high coefficient of friction, so that there is a problem in that the composite plated products can not used as the materials of long-life contacts and terminals. Therefore, it is desired to provide a composite plated product which has a larger content of carbon and a larger quantity of carbon particles on the surface thereof than those of the composite plated products produced by the conventional methods and which has a better wear resistance than that of the composite plated products produced by the conventional methods.

SUMMARY OF THE INVENTION

It is therefore an object of the present invention to eliminate the aforementioned problems and to provide a composite plated product which has a large content of carbon and a large quantity of carbon particles on the surface thereof and which has an excellent wear resistance, and a method for producing the same by sufficiently dispersing carbon particles in a silver plating solution without using any additives such as dispersing agents and without coating the surface of carbon particles.

In order to accomplish the aforementioned and other objects, the inventors have diligently studied and found that it is possible to produce a composite plated product which has a large content of carbon and a large quantity of carbon particles on the surface thereof and which has an excellent wear resistance, by electroplating a substrate serving as a raw material with a composite material of silver and carbon particles in a silver plating solution in which carbon particles treated by an oxidation treatment are dispersed. Thus, the inventors have made the present invention.

According one aspect of the present invention, according to one aspect of the present invention, there is provided a method for producing a composite plated product, the method comprising the steps of: treating carbon particles by an oxidation treatment; adding the treated carbon particles to a silver plating solution; and electroplating a substrate in the silver plating solution containing the treated carbon particles, to form a coating of a composite material, which contains the treated carbon particles in a silver layer, on the substrate. In this method for producing a composite plated product, the oxidation treatment is preferably a wet oxidation treatment which is preferably a process for adding an oxidizing agent to water in which carbon particles are suspended. The oxidizing agent may be selected from the group consisting of nitric acid, hydrogen peroxide, potassium permanganate, potassium persulfate, sodium persulfate and sodium perchlorate. The silver plating solution may be a cyanide containing silver plating solution. The carbon particles may be scale-shaped graphite particles having a thickness of 0.1 to 1.0 μm, preferably 0.1 to 0.5 μm, and a mean particle diameter of 1 to 10 μm, preferably 3 to 8 μm.

According to another aspect of the present invention, a composite plated product comprises: a substrate; and a coating of a composite material containing carbon particles in a silver layer, the coating being formed on the substrate, wherein the content by weight of carbon in the coating is 0.7 wt % or more, preferably 1.3 wt % or more. In this composite plated product, the quantity of the carbon particles on a surface of the coating is preferably 10 area % or more, and more preferably 20 area % or more. The coating preferably has a thickness of 3 to 7 μm.

According to a further aspect of the present invention, an electric contact comprises: a stationary contact; and a movable contact for sliding on the stationary contact, wherein at least a part of at least one of the stationary and movable contacts contacting the other contact is made of the above described composite plated product.

Throughout the specification, the terms "thickness" and "particle diameter" of carbon particles mean the thickness and diameter of carbon particles assuming that each of the carbon particles has a disk shape.

According to the present invention, it is possible to sufficiently disperse carbon particles in a silver plating solution without using any additives such as dispersing agents and without coating the surface of carbon particles, so that it is possible to produce a composite plated product which has a large content of carbon and a large quantity of carbon particles on the surface thereof and which has an excellent wear resistance.

BRIEF DESCRIPTION OF THE DRAWINGS

The present invention will be understood more fully from the detailed description given here below and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

In a preferred embodiment of a method for producing a composite plated product according to the present invention, a coating of a composite material, which comprises a silver layer and carbon particles dispersed therein, is formed on a conductive material by electroplating the conductive material in a silver plating solution to which carbon particles treated by an oxidation treatment are added. If carbon particles are added to a silver plating solution to be suspended therein without using any dispersing agents, it is not possible to incorporate the carbon particles into a coating. However, if an oxidation treatment for carbon particles is carried out before adding the carbon particles to a silver plating solution as this preferred embodiment, it is possible to improve the dispersibility of the carbon particles without using any dispersing agents.

In the preferred embodiment of a method for producing a composite plated product according to the present invention, lipophilic organic substances absorbed onto the surface of carbon particles are removed by the oxidation treatment before the carbon particles are added to a silver plating solution. Such lipophilic organic substances include aliphatic hydrocarbons, such as alkanes (e.g., nonane, decane) and alkenes (e.g., methylheptene), and aromatic hydrocarbons, such as alkylbenzene (e.g., xylene).

As the oxidation treatment for carbon particles, a wet oxidation treatment, a dry oxidation treatment using oxygen gas or the like may be used. In view of mass production, a wet oxidation treatment is preferably used. If a wet oxidation treatment is used, it is possible to uniformly treat carbon particles having a large surface area.

Figure 1:
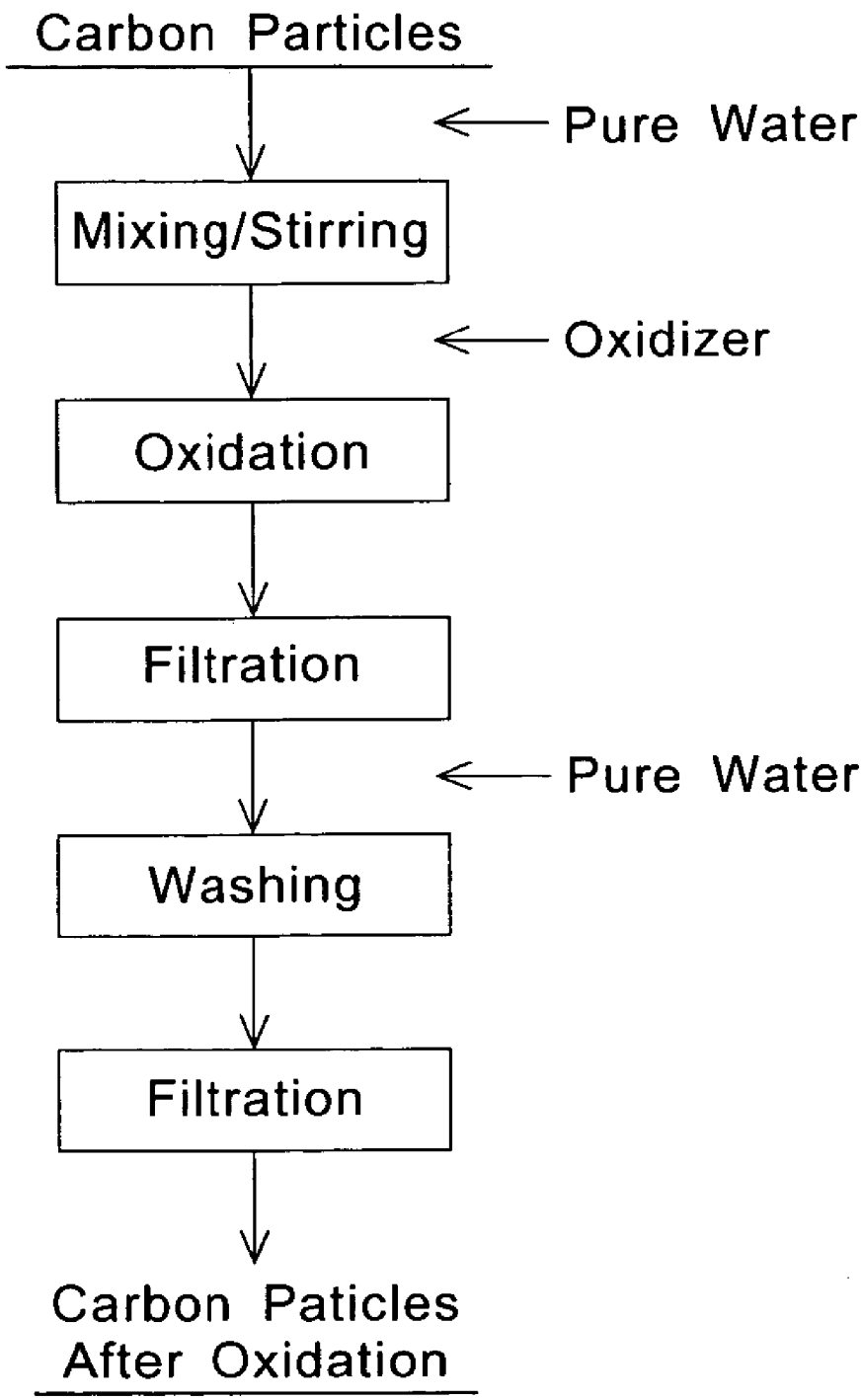
FIG. 1 is a flow chart showing a process for carrying out an oxidation treatment for carbon particles in a preferred embodiment of a method for producing a composite plated product according to the present invention.

As the wet oxidation treatment, there may be used a method for suspending carbon particles in an aqueous solution containing a conductive salt to put therein platinum electrodes or the like as a cathode and anode to carry out electrolysis, and a method for suspending carbon particles in water to add an optimum quantity of oxidizing agent thereto. In view of productivity, the latter is preferably used, and the quantity of carbon particles added to water is preferably in the range of from 1 wt % to 20 wt %. The oxidizing agent may be nitric acid, hydrogen peroxide, potassium permanganate, potassium persulfate, sodium persulfate, sodium perchlorate or the like. It is considered that the lipophilic organic substances adhering to carbon particles are oxidized by the added oxidizing agent so as to be soluble in water to be suitably removed from the surface of the carbon particles. If the carbon particles treated by the wet oxidation treatment are filtered and washed as shown in FIG. 1, it is possible to further enhance the function of removing the lipophilic organic substances from the surface of the carbon particles.

The lipophilic organic substances, such as aliphatic and aromatic hydrocarbons, can be thus removed from the surface of the carbon particles by the above described oxidation treatment. According to analysis based on gases heated at 300° C., gases generated by heating carbon particles to 300° C. after the oxidation treatment hardly contain lipophilic aliphatic hydrocarbons such as alkanes and alkens, and lipophilic aromatic hydrocarbons such as alkylbenzenes. Even if the carbon particles after the oxidation treatment slightly contain aliphatic and aromatic hydrocarbons, the carbon particles can be dispersed in a silver plating solution. However, the carbon particles do not preferably contain hydrocarbons having a molecular weight of 160 or more, and the intensity (the intensity in purge and gas chromatography and mass spectroscopy) of gases generated at 300° C. from hydrocarbons having a molecular weight of less than 160 in the carbon particles is preferably 5,000,000 or less. It is considered that, if the carbon particles contain hydrocarbons having a large molecular weight, the surface of each of the carbon particles is coated with strong lipophilic hydrocarbons, and the hydrocarbons are coagulated in the silver plating solution which is an aqueous solution, so that the carbon particles do not form a coating of a composite material.

When carbon particles, from which aliphatic and aromatic hydrocarbons are removed by the above described oxidation treatment, are suspended in the silver plating solution to carry out electroplating, a cyanide containing silver plating solution is preferably used as the silver plating solution. In the conventional methods, it is required to add a surface active agent to a cyanide containing silver solution if such a plating solution is used. However, in a preferred embodiment of a method for producing a composite plated product according to the present invention, it is not required to add any surface active agents to the silver plating solution, since it is possible to obtain a composite plating solution wherein carbon particles are uniformly dispersed in the silver plating solution even if no surface active agent is added thereto.

If a cyanide containing silver plating solution is used, it is possible to obtain a composite coating which has a large content of carbon and a large quantity of carbon particles on the surface thereof. It is considered that the reason why the content of carbon in the coating is increased is that carbon particles are easily incorporated into a silver matrix since the silver plating solution does not contain any surface active agents to prevent the surface active agents from being absorbed onto the growth surface of a silver plating crystal when the crystal grows. It is also considered that the reason why the quantity of carbon particles on the surface of the coating is increased is that it is difficult for the carbon particles to be removed from the surface of the coating (similar to the cleaning function of detergent) during washing after plating, since the silver plating solution does not contain any surface active agents.

If carbon particles treated by the oxidation treatment are thus added to a silver plating solution, it is possible to sufficiently disperse the carbon particles in the silver plating solution without using any additives such as dispersing agents and without coating the surface of the carbon particles. In addition, if such a silver plating solution is used for carrying out electroplating, it is possible to produce a composite plated product, wherein a coating of a composite material having the carbon particles dispersed in a silver layer is formed on a substrate serving as a raw material, which has a large content of carbon and a large quantity of carbon particles on the surface thereof and which has an excellent wear resistance.

Furthermore, the wear resistance of the composite plated product is improved as the content of carbon in the coating is increased. In a composite plated product produced by the preferred embodiment of a method for producing a composite plated product according to the present invention, the content by weight of carbon in the coating can be 0.7 wt % or more, preferably 1.3 wt % or more, and the quantity of carbon particles on the surface of the coating can be 10 area % or more, preferably 20 area % or more, so that it is possible to obtain a composite plated product having an excellent wear resistance.

Figure 2:
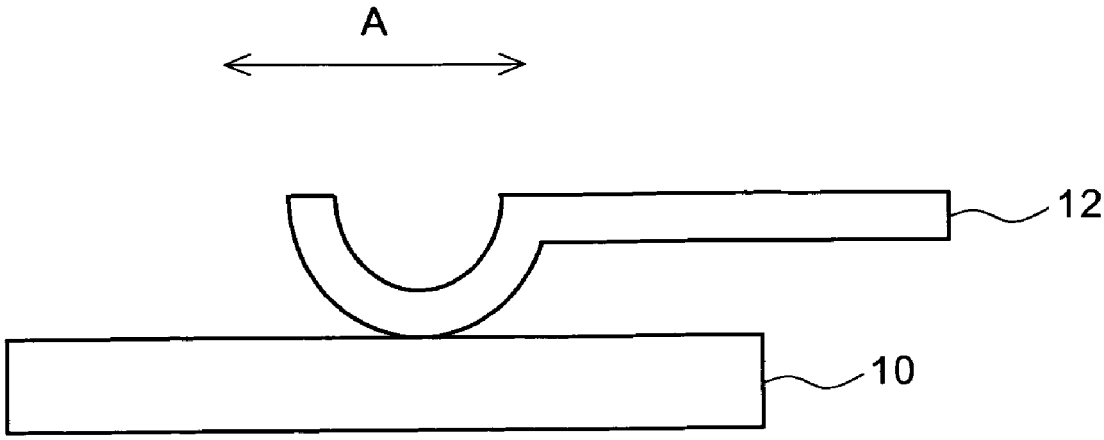
FIG. 2 is a schematic diagram for explaining an electric contact using a composite plated product according to the present invention.

In an electric contact comprising a stationary contact 10 and a movable contact 12 which is slidable on the stationary contact 10 in directions shown by arrow A in FIG. 2, if at least one of the stationary contact 10 and the movable contact 12 is formed of a composite plated product according to the present invention, the electric contact can have an excellent wear resistance. In this case, only a part of one of the stationary contact 10 and the movable contact 12 contacting the other contact may be formed of a composite plate product according to the present invention.

Examples of a composite plated product and a method for producing the same according to the present invention will be described below in detail.

EXAMPLES 1 THROUGH 8

As shown in Table 1, scale-shaped (or flake-shaped) and soil-grain-shaped graphite particles having a thickness of 0.1 to 0.5 μm and a mean particle diameter of 3 to 8 μm were prepared as carbon particles. In the examples and comparative examples, the thickness of the carbon particle was measured by observing a scanning electron microphotograph (SEM photograph). The mean particle diameter of the carbon particles was obtained as follows. First, 0.5 g of carbon particles were dispersed in 50 g of a solution containing 0.2 wt % of sodium hexametaphosphate, and further dispersed by ultrasonic waves. Then, particle diameters of the carbon particles in a distribution based on volume were measured by means of a laser light scattering particle-size distribution measuring device, and a particle diameter at 50% in a cumulative distribution was assumed as the mean particle diameter.

Then, the graphite particles were put into pure water to carry out a wet oxidation treatment using potassium persulfate as an oxidizing agent.

Then, the graphite particles thus treated were added to an alkaline cyanide containing silver plating solution comprising 100 g/l of potassium silver cyanide, 120 g/l of potassium cyanide and 4 mg/l of potassium selenocyanate serving as a brightening agent.

Then, a copper plate serving as a raw material was electroplated in the above described silver plating solution at a temperature of 25° C. and at a current density of 1 or 6 A/dm$^2$ to produce a composite plated product wherein a composite coating of silver and graphite particles having a thickness of 5 μm was formed on the copper plate.

Samples were cut out of the composite plated product (containing the raw material) to be prepared for analyses of Ag and C, respectively. The content by weight (X wt %) of Ag in the sample was obtained by the plasma spectroscopic analysis by means of an ICP device (IRIS/AR produced by Jarrell Ash Corporation), and the content by weight (Y wt %) of C in the sample was obtained by the infrared analysis by means of a carbon/sulfur microanalyzer (EMIA-U510 produced by HORIBA, Ltd.). Then, the content by weight of C in the coating was calculated as Y/(X+Y). As a result, the content by weight of C in the coating was in the range of from 0.7 to 2.1% by weight (7.1 to 10.5% by volume). In addition, a cross section of the coating was observed by means of a scanning electron microscope (SEM). As a result, it was confirmed that the coating was formed of a composite material containing graphite particles in a silver layer.

One of two composite plated products thus obtained was intended to be used as an indenter, and the other composite plated product was used as an evaluating sample, so that the wear resistance of the composite plated product was evaluated by carrying out an abrasion test for confirming the wearing state of the composite plated product by continuing the reciprocating sliding movement (sliding distance: 14 mm, sliding speed: 2 Hz) of the indenter while pushing the indenter against the evaluating sample at a constant load (100 g) until the raw material was exposed. As a result, in Examples 1 through 8, the raw material was not exposed after the reciprocating sliding movement was repeated 20,000 times or more. Particularly in Examples 1, 3, 5 and 7, the raw material was not exposed after the reciprocating sliding movement was repeated 150,000 times or more, so that it was found that the composite plate product had an excellent wear resistance.

COMPARATIVE EXAMPLES 1 THROUGH 6

A copper plate serving as a raw material was plated with silver by the same method as that in Examples 1 through 8, except that the oxidation treatment was not carried out, and the measurement of the content by weight of graphite particles in a coating and the evaluation of the wear resistance thereof were carried out. As a result, it was found that the coating contained no graphite particle so as not form a composite material containing graphite particles in a silver layer. In addition, it was found that the raw material was exposed after the reciprocating sliding movement was repeated below 1,000 times and that the wear resistance was bad.

The results in Examples 1 through 8 and Comparative Examples 1 through 6 are shown in Table 1.

TABLE 1

| | C Particles for Raw Material | | | C Particles for Plating | | | |
|---|---|---|---|---|---|---|---|
| | Shape | Mean Diameter (μm) | Oxidation | Suspended Carbon (g/l) | Current Density (A/dm$^2$) | Content of C (wt %) | Wear Resistance (times) |
| Ex. 1 | scale | 3.4 | X | 80 | 1 | 1.8 | over 100,000 |
| Ex. 2 | scale | 3.4 | X | 80 | 6 | 1.5 | over 50,000 |
| Ex. 3 | scale | 5.8 | X | 80 | 1 | 1.7 | over 150,000 |
| Ex. 4 | scale | 5.8 | X | 80 | 6 | 1.3 | over 50,000 |
| Ex. 5 | scale | 5.8 | X | 120 | 1 | 2.1 | over 150,000 |

TABLE 1-continued

| | C Particles for Raw Material | | | C Particles for Plating | | | |
|---|---|---|---|---|---|---|---|
| | Shape | Mean Diameter (μm) | Oxidation | Suspended Carbon (g/l) | Current Density ($A/dm^2$) | Content of C (wt %) | Wear Resistance (times) |
| Ex. 6 | scale | 5.8 | X | 120 | 6 | 0.7 | over 20,000 |
| Ex. 7 | scale | 8.3 | X | 80 | 1 | 1.5 | over 150,000 |
| Ex. 8 | soil | 4.0 | X | 80 | 1 | 1.3 | over 50,000 |
| Comp. 1 | scale | 3.4 | — | 80 | 1 | — | Below 1,000 |
| Comp. 2 | scale | 3.4 | — | 80 | 6 | — | below 1,000 |
| Comp. 3 | scale | 5.8 | — | 80 | 1 | — | below 1,000 |
| Comp. 4 | scale | 5.8 | — | 80 | 6 | — | below 1,000 |
| Comp. 5 | soil | 4.0 | — | 80 | 1 | — | below 1,000 |
| Comp. 6 | soil | 4.0 | — | 80 | 6 | — | below 1,000 |

As can be seen from Table 1, in Comparative Examples 1 through 6 wherein the oxidation treatment is not carried out, the raw material is exposed after the reciprocating sliding movement is repeated below 1,000 times, whereas in Examples 1 through 8 wherein the oxidation treatment is carried out, the raw material is not exposed after the reciprocating sliding movement is repeated over 20,000 times, and particularly in Examples 1, 3, 5 and 7, the raw material is not exposed after the reciprocating sliding movement is repeated over 150,000 times, so that the wear resistance is excellent. Thus, since the composite plated product in Examples 1 through 8 has a good wear resistance, it is not required to apply grease on a contact portion of a sliding contact part when the composite plated product is used as the material of the sliding contact part, so that it is possible to solve problems, such as the deterioration in function due to the deterioration of the grease.

EXAMPLES 9 THROUGH 11

First, scale-shaped graphite particles (CARBON SN-5 produced by SEC Corporation) having a mean particle diameter of 5 μm were prepared as carbon particles, and potassium persulfate was prepared as an oxidizing agent. Then, 6 wt % of graphite particles were added to 3 L of pure water, and this mixed solution was heated to 50° C. while being stirred. Then, 1.2 L of a solution containing 0.1 mol/l of potassium persulfate was gradually dropped to the mixed solution, and then, stirred for two hours to carry out an oxidation treatment. Thereafter, filtration was carried out by means of a filter paper, and washing was carried out.

Figure 3:
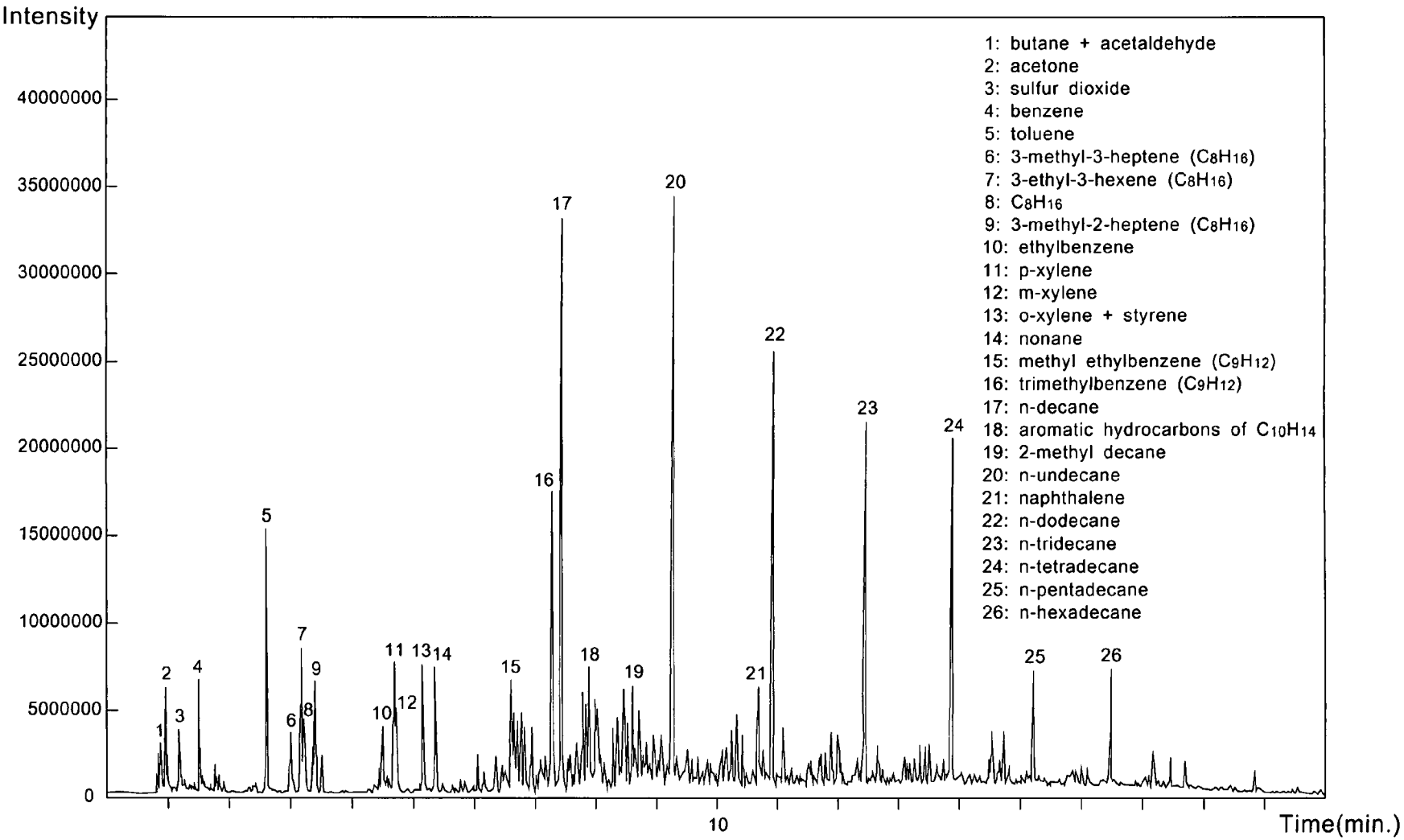
FIG. 3 is a graph showing the results of the analysis of gases generated at 300° C. from carbon particles before an oxidation treatment.
Figure 4:
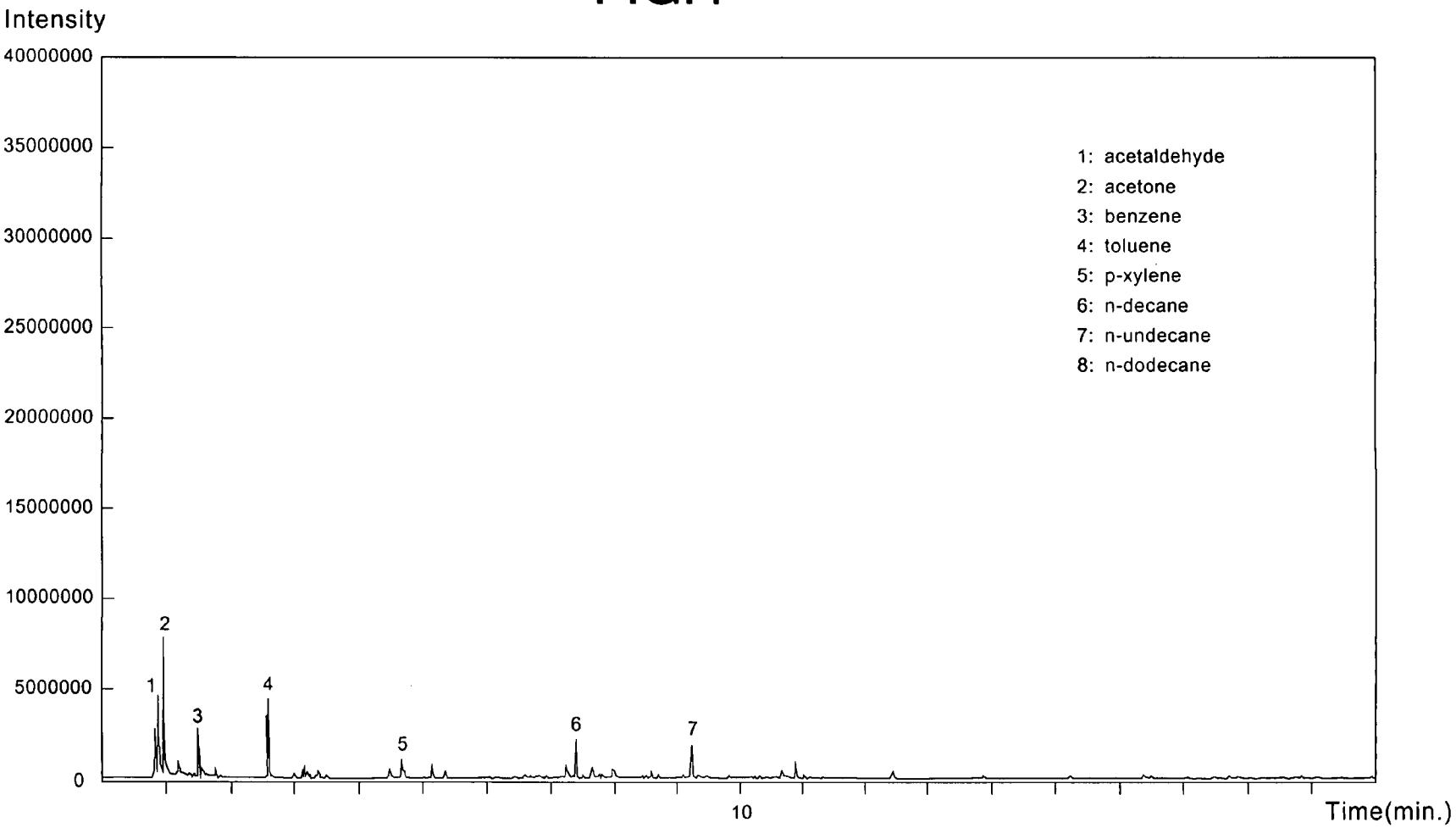
FIG. 4 is a graph showing the results of the analysis of gases generated at 300° C. from carbon particles after an oxidation treatment.

With respect to carbon particles before and after the oxidation treatment, gases generated at 300° C. were analyzed by means of a purge and gas chromatography and mass spectrometer (Japan Analysis Industry JHS-100) (GCMAS QP-5050A produced by Shimadzu Corp.) on conditions of purge and trap shown in Table 2 and on conditions of CGMS analysis shown in Table 3. The results are shown in Table 4, and the results of the analyses of carbon particles before and after the oxidation treatment are shown in FIGS. 3 and 4, respectively. As can be seen from Table 4 and FIGS. 3 and 4, lipophilic aliphatic hydrocarbons, such as nonane, decane and 3-methyl-2-hepten, and lipophilic aromatic hydrocarbons, such as xylene, were removed from the carbon particles by the above described oxidation treatment.

TABLE 2

| conditions of purge and trap | |
|---|---|
| purge temp. | 300° C. |
| purge time | 20 min. |
| trap temp. | −60° C. |
| absorbent | glass wool |
| thermal desorption temp. | 358° C. |
| thermal desorption time | 25 sec. |
| amount of sample | 200 mg |

TABLE 3

| conditions of GCMS analysis | |
|---|---|
| column | DB-5ms 0.25 mm I.D. × 30 m |
| column temp. | 40° C. (3 min.) →10° C./min.→300° C. |
| inlet temp. | 300° C. |
| carrier | He 100 kPa |
| injecting method | split (1:30) |
| ionizing method | EI |
| detector gain | 1.70 kV |
| interface temp. | 250° C. |
| mass range | 20-900 m/z |

TABLE 4

| | Kind | Material Name | Molecular Weight | Peak Intensity Before Oxidation | Peak Intensity After Oxidation |
|---|---|---|---|---|---|
| A | alkene | buten | 56.11 | 3144919 | 4607692 |
| L | | 3-methyl-3-heptene | 112.21 | 3784837 | |
| | | 3-ethyl-3-hexene | 112.21 | 8545655 | |
| | | 3-methyl-2-heptene | 112.21 | 6635173 | |
| | alkane | nonane | 128.26 | 7517631 | |
| | | n-decane | 142.28 | 33201250 | 2247064 |
| | | n-undecane | 156.31 | 34487440 | 1960814 |
| | | n-dodecane | 170.33 | 25659890 | |
| | | n-tridecane | 184.36 | 21593880 | |
| | | n-tetradecane | 198.39 | 20702350 | |
| | | n-pentadecane | 212.42 | 7383416 | |
| | | n-hexadecane | 226.44 | 7460682 | |
| | | 2-methyldecane | 240.47 | 6486639 | |
| A | benzene | benzene | 78.11 | 6774720 | 2834457 |
| R | | toluene | 92.14 | 15352830 | 4401590 |
| | | ethylbenzene | 106.17 | 4157454 | |
| | | p-xylene | 106.17 | 7788405 | 1021066 |
| | | m-xylene | 106.17 | 5125236 | |
| | | o-xylene | 106.17 | 7625775 | |
| | | trimethyl benzene | 120.19 | 17572940 | |
| | | methylbenzene | 120.19 | 6787947 | |
| | | styrene | 104.15 | 7625775 | |
| | naphthalene | naphthalene | 128.17 | 6481065 | |
| | | $C_8H_{16}$ | 112.21 | 4510563 | |
| | | aromatic hydrocarbons of $C_{10}H_{14}$ | 134.22 | 7537705 | |
| O | ketone | acetaldehyde | 44.05 | 3144919 | 4607692 |
| | | acetone | 58.08 | 6291980 | 7838290 |
| R | | sulfur dioxide | | 3924202 | |
| | | air ($N_2$, $CO_2$, $O_2$) | | 2526328 | 2857783 |

AL: aliphatic hydrocarbons
AR: aromatic hydrocarbons
O: containing oxygen
R: others Then, 40 g/l (Example 9), 80 g/l (Example 10) and 120 g/l (Example 11) of carbon particles treated by the above described oxidation treatment were added to a cyanide containing silver plating solution comprising 100 g/l of potassium silver cyanide, 120 g/l of potassium cyanide and 4 mg/l of potassium selenocyanate to be dispersed and suspended therein to prepare composite plating solutions of silver and carbon particles, respectively. Each of these composite plating solutions is used for electroplating a copper plate serving as a raw material at a temperature of 25° C. and at a current density of 1 A/dm$^2$ to produce a composite plated product wherein a composite coating of silver and carbon particles having a thickness of 5 μm was formed on the copper plate.

With respect to the composite plated products thus obtained, the content by weight of carbon in the coating was calculated by the same method as that in Examples 1 through 8. As a result, the content by weight of carbon in the coating was 1.5 wt % in Example 9, 2.2 wt % in Example 10, and 2.0 wt % in Example 11.

The surface of a test piece cut out of each of the composite plated products was observed, and the quantity (% by area) of carbon particles on the surface of the coating was calculated as follows. First, an image of the surface of the test piece was taken as a super depth image at an objective lens power of 100 by means of a super depth shape microscope (VK-8500 produced by KEYENCE CORPORATION). Then, an image analyzing application (SCION IMAGE produced by SCION CORPORATION) was used on a personal computer for incorporating the image as a monochrome to indicate the contrast of the image as binary digits, so that the portions of silver were separated from the portions of carbon particles. Then, the quantity of carbon particles on the surface of the coating was calculated as a ratio Y/X of the number (Y) of pixels of the portions of carbon particles to the number (X) of pixels of the whole image. As a result, the quantity of carbon particles on the surface of the coating was 28 area % in Example 9, 32 area % in Example 10, and 30 area % a in Example 11.

Then, a cyanide containing silver plating solution comprising 100 g/l of potassium silver cyanide and 120 g/l of potassium cyanide was used as a plating solution for producing a silver-plated product wherein a silver coating having a thickness of 5 μm was formed on a copper plate having a thickness of 0.3 mm. Then, the coefficient of friction between the test piece cut out of the composite plated product and the silver-plated product thus produced was obtained. This coefficient of friction (μ) was calculated as follows. First, the test piece cut out of the composite plated product was indented (R=3 mm) to be used as a convex indenter, and the plate-shaped silver-plated product was used as an evaluating sample on the base side. A load cell was used for sliding the indenter on the evaluating sample at a moving speed of 60 mm/min while pushing the indenter against the evaluating sample at a load of 3 N, and a force (F) applied in horizontal directions was measured. Then, the coefficient of friction was calculated from μ=F/N. As a result, the coefficient of friction was 0.26 in Example 9, 0.34 in Example 10, and 0.32 in Example 11.

EXAMPLES 12 AND 13

Composite plated products of silver and carbon particles were produced by the same method as that in Example 10, except that scale-shaped graphite particles (CARBON SGP-3 and SGP-8 produced by SEC Corporation) having mean particle sizes of 3 μm (Example 12) and 8 μm (Example 13) were used as carbon particles, respectively. With respect to the composite plated products thus produced, the content by weight of carbon in the coating, the quantity of carbon particle on the surface of the coating, and the coefficient of friction of the composite plated product were obtained. As a result, in Examples 12 and 13, the content by weight of carbon in the coating was 1.8 wt % and 1.7 wt %, the quantity of carbon particles on the surface of the coating was 30 area % and 27 area %, and the coefficient of friction of the composite plated product was 0.30 and 0.31, respectively.

COMPARATIVE EXAMPLE 7

A silver-plated product was produced by the same method as that in Example 10, except that the oxidation treatment was not carried out. With respect to the silver-plated product thus produced, the content by weight of carbon in the coating, the quantity of carbon particles on the surface of the coating, and the coefficient of friction of the silver-plated product were obtained. As a result, the content by weight of carbon in the coating was 0 wt %, and the quantity of carbon particles on the surface of the coating was 0 area %, so that carbon particles did not form a composite material. In addition, the coefficient of friction of the silver-plated product was 1.23 which was far higher than that in Examples 9 through 13.

Furthermore, as can be seen from the results of the analysis of gases generated at 300° C. as shown in Table 4 and FIG. 3, if the oxidation treatment is not carried out as this comparative example, a large number of peaks exhibiting lipophilic aliphatic and aromatic hydrocarbons appear so that lipophilic aliphatic and aromatic hydrocarbons adhere to graphite particles. In addition, if graphite particles were not treated by the oxidation treatment as this comparative example, the graphite particles were coagulated in the plating solution, so that it was not possible to uniformly suspend the graphite particles therein.

COMPARATIVE EXAMPLE 8

A composite plated product was produced by the same method as that in Comparative Example 7, except that 5 ml/l of sodium lauryl sulfate having the function of highly dispersing carbon particles was added to a plating solution as a surface active agent. With respect to the composite plated product thus produced, the content by weight of carbon in the coating, the quantity of carbon particles on the surface of the coating, and the coefficient of friction of the composite plated product were obtained. As a result, the content by weight of carbon in the coating, and the quantity of carbon particles on the surface of the coating were 1.1 wt % and 5 area %, respectively, which were far smaller than those in Examples 9 through 13. In addition, the coefficient of friction of the composite plated product was 0.50 which was higher than that in Examples 9 through 13.

The results in Examples 9 through 13 and Comparative Examples 7 and 8 are shown in Table 5.

TABLE 5

| | | Gases generated at 300° C. | | | | | | | |
|---|---|---|---|---|---|---|---|---|---|
| | O | Molecular Weight over 160 | Molecular Weight below 160 | D | Q | S | C | A | F |
| Ex. 9 | X | not | Intensity | 5 | 40 | — | 1.5 | 28 | 0.26 |
| Ex. 10 | X | detected | of AL and | 5 | 80 | — | 2.2 | 32 | 0.34 |
| Ex. 11 | X | | AR is not | 5 | 120 | — | 2.0 | 30 | 0.32 |
| Ex. 12 | X | | more than | 3 | 80 | — | 1.8 | 30 | 0.30 |
| Ex. 13 | X | | 5,000,000 | 8 | 80 | — | 1.7 | 27 | 0.31 |
| Comp. 7 | — | AL and AR | Intensity of AL and | 5 | 80 | — | 0 | 0 | 1.23 |

TABLE 5-continued

| | O | Gases generated at 300° C. Molecular Weight over 160 | Molecular Weight below 160 | D | Q | S | C | A | F |
|---|---|---|---|---|---|---|---|---|---|
| Comp. 8 | — | | AR is over 5,000,000 | 5 | 80 | X | 1.1 | 5 | 0.50 |

O: oxidation treatment
D: particle diameter (μm) of carbon particles
Q: quantity of suspended carbon particles
S: surface active agent
C: content (% by weight) of carbon
A: quantity (% by area) of carbon particles on surface
F: coefficient of friction
AL: aliphatic hydrocarbons
AR: aromatic hydrocarbons While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A method for producing a composite plated product, the method comprising the steps of:

treating carbon particles by a wet oxidation treatment which adds an oxidizing agent to a suspension which contains the carbon particles suspended in water for removing lipophilic organic substances from the carbon particles;

adding the treated carbon particles to a silver plating solution to disperse and suspend the treated carbon particles therein without using any additives and without coating the surface of said carbon particles to prepare a composite plating solution of silver and the treated carbon particles; and electroplating a substrate in the composite plating solution containing the treated carbon particles dispersed and suspended therein, to form a coating of a composite material, which contains the treated carbon particles in a silver layer, on the substrate, wherein said carbon particles are scale-shaped graphite particles having a thickness of 0.1 to 1.0 μm and a mean particle diameter of 1 to 10 μm.

2. A method for producing a composite plated product as set forth in claim 1, wherein said oxidizing agent is selected from the group consisting of nitric acid, hydrogen peroxide, potassium permanganate, potassium persulfate, sodium persulfate and sodium perchlorate.

3. A method for producing a composite plated product as set forth in claim 1, wherein said silver plating solution is a cyanide containing silver plating solution.

4. A method for producing a composite plated product as set forth in claim 1, wherein said carbon particles are scale-shaped graphite particles having a thickness of 0.1 to 0.5 μm and a mean particle diameter of 3 to 8 μm.

5. A method for producing a composite plated product, the method comprising the steps of:

treating carbon particles by a wet oxidation treatment, which is a process for adding potassium persulfate serving as an oxidizing agent to a suspension which contains the carbon particles suspended in water, for removing lipophilic organic substances from the carbon particles;

adding the treated carbon particles to a silver plating solution to disperse and suspend the treated carbon particles therein to prepare a composite plating solution of silver and the treated carbon particles; and electroplating a substrate in the composite plating solution containing the treated carbon particles dispersed and suspended therein, to form a coating of a composite material, which contains the treated carbon particles in a silver layer, on the substrate.

6. A method for producing a composite plated product as set forth in claim 5, wherein said silver plating solution is a cyanide containing silver plating solution.

7. A method for producing a composite plated product as set forth in claim 5, wherein said carbon particles are scale-shaped graphite particles having a thickness of 0.1 to 1.0 μm and a mean particle diameter of 1 to 10 μm.

8. A method for producing a composite plated product as set forth in claim 5, wherein said carbon particles are scale-shaped graphite particles having a thickness of 0.1 to 0.5 μm and a mean particle diameter of 3 to 8 μm.

9. A method for producing a composite plated product, the method comprising the steps of:

treating scale-shaped graphite particles by a wet oxidation treatment, which is a process for adding an oxidizing agent to a suspension which contains the graphite particles suspended in water, for removing lipophilic organic substances from the graphite particles;

adding the treated graphite particles to a silver plating solution to disperse and suspend the treated graphite particles therein to prepare a composite plating solution of silver and the treated graphite particles; and electroplating a substrate in the composite plating solution containing the treated graphite particles dispersed and suspended therein, to form a coating of a composite material, which contains the treated graphite particles in a silver layer, on the substrate, wherein said graphite particles have a thickness of from 0.1 to 1.0 μm and a mean particle diameter of 1 to 10 μm.

10. A method for producing a composite plated product as set forth in claim 9, wherein said oxidizing agent is selected from the group consisting of nitric acid, hydrogen peroxide, potassium permanganate, potassium persulfate, sodium persulfate and sodium perchlorate.

11. A method for producing a composite plated product as set forth in claim 9, wherein said silver plating solution is a cyanide containing silver plating solution.

12. A method for producing a composite plated product as set forth in claim 9, wherein said graphite particles have a thickness of 0.1 to 0.5 μm and a mean particle diameter of 3 to 8 μm.

* * * * *